US005773799A

United States Patent [19]

Maxfield et al.

[11] Patent Number: 5,773,799

[45] Date of Patent: Jun. 30, 1998

[54] HIGH-FREQUENCY INDUCTION HEATING POWER SUPPLY

[75] Inventors: Mark Maxfield, Los Gatos; Frank A. Doljack, Pleasanton, both of Calif.

[73] Assignee: Gas Research Institute, Chicago, Ill.

[21] Appl. No.: 626,068

[22] Filed: Apr. 1, 1996

[51] Int. Cl.[6] ..... H05B 6/06

[52] U.S. Cl. ..... 219/661; 219/663; 219/626; 219/666; 363/98; 363/132

[58] Field of Search ..... 219/661, 662, 219/663, 664, 665, 625, 626, 666; 363/17, 40, 41, 98, 132

[56] References Cited

U.S. PATENT DOCUMENTS

| | | | |
|---|---|---|---|
| 3,770,928 | 11/1973 | Kornrumpf et al. . | |
| 3,806,791 | 4/1974 | Johnson | 363/37 |
| 3,814,888 | 6/1974 | Bowers et al. . | |
| 3,843,857 | 10/1974 | Cunningham . | |
| 4,017,701 | 4/1977 | Mittelmann . | |
| 4,097,863 | 6/1978 | Chambers | 363/16 |
| 4,253,139 | 2/1981 | Weiss . | |
| 4,471,196 | 9/1984 | Frank et al. | 219/665 |
| 4,616,305 | 10/1986 | Damiano et al. . | |
| 4,636,927 | 1/1987 | Rhyne et al. . | |
| 4,652,985 | 3/1987 | Bouglé . | |
| 4,656,570 | 4/1987 | Swoboda | 363/41 |
| 4,685,041 | 8/1987 | Bowman et al. | 363/40 |
| 4,775,821 | 10/1988 | Sikora . | |
| 4,885,447 | 12/1989 | Sánchez González . | |
| 4,954,753 | 9/1990 | Sikora . | |
| 5,255,178 | 10/1993 | Liberati . | |
| 5,274,541 | 12/1993 | Kimura et al. . | |
| 5,343,023 | 8/1994 | Geissler | 219/661 |

FOREIGN PATENT DOCUMENTS 8002124 10/1980 WIPO .

OTHER PUBLICATIONS

Smartheat Fittings For Joining Polyethylene Gas Pipe: Tests, Field Trials and Advancements; Cin Smith, Metcal Inc., Menlo Park, CA, and Mike Zandaroski, Minnegasco, (a Division of Arkla, Inc.), Minneapolis, Minn. (Apr. 1994).

Smartheat Fittings For Joining Polyethylene Gas Pipe: Tests, Field Trials and Advancements; Cin Smith, Raychem Inc., Menlo Park, CA (Jan. 1996).

*Primary Examiner*—Philip H. Leung

*Attorney, Agent, or Firm*—Speckman Pauley Petersen & Fejer

[57] ABSTRACT

A high-frequency power supply which is primarily intended for use with an inductive heating apparatus. The high-frequency power supply has a pre-regulator for emitting a constant output voltage, an inverter for generating a constant output voltage, and an output network for amplifying the constant output voltage and converting the constant output voltage to a high-frequency constant output current. The power supply disclosed generates a very high frequency ac output, drives a wide range of possible loads, minimizes root mean square input current for a given output power, and can be powered from a wide range of input power sources.

16 Claims, 2 Drawing Sheets

HIGH-FREQUENCY INDUCTION HEATING POWER SUPPLY

BACKGROUND OF THE INVENTION

1. Field of the Invention

This invention relates to a high-frequency power supply which is preferably used with inductive heating devices.

2. Description of Prior Art

Induction heating has many applications including cooking, plastic pipe coupling, and other applications which require focused, controlled, predictable heating. Induction heating is accomplished by applying an alternating current to a coil adjacent to a metal element so that the magnetic flux produced by the current in the coil induces a voltage in the element, which produces the necessary current flow. The induction heating apparatus requires a power supply which can produce a very high frequency alternating current output, efficiently drive a wide range of possible loads, and minimize electromagnetic interference and root mean square input current for a given output power.

U.S. Pat. No. 4,885,447 discloses a system for the induction heating of an electric hot plate. The apparatus of the '447 patent includes a dc power supply, an H-shaped inverter bridge, and activated and varies electric current pulses through a heating coil.

U.S. Pat. No. 4,616,305 discloses a power MOSFET reversing H-drive system. The '305 Patent discloses a system wherein the intrinsic diodes of the MOSFETs are matched to the requirements of the driven load.

U.S. Pat. No. 4,775,821 and 4,954,753 disclose dc to dc converters. The converters contain a regulator circuit enabling the converters to operate over a wide range of dc input voltages. Neither such patent addresses problems associated with induction heating power supplies requiring high-frequency ac output.

The induction heating power supply of this invention has special requirements which make it unique from other induction heating power supplies. One is that the unit provides a relatively very high frequency ac output current. Another requirement is that the unit is able to efficiently drive a wide range of possible loads. A third requirement is that the unit draws nearly a pure sine wave current signal from the power source, which minimizes root mean square input current for a given output power. Another requirement is to power the unit from various types of input power sources including power lines, generators, and inverters. The unit according to this invention works with a wide range of input voltages and input voltage waveforms.

Thus it is apparent that a reliable and economical power supply for generating a high-frequency, efficient and predictable output current, particularly in the induction heating industry, is highly desirable.

SUMMARY OF THE INVENTION

It is one object of this invention to provide a power supply which can produce a relatively high-frequency ac output current.

It is another object of this invention to provide a power supply which can efficiently drive a wide range of possible loads.

It is yet another object of this invention to provide a power supply which can be powered from various types of input power sources.

It is yet another object of this invention to provide a power supply which can function with a wide range of input voltages.

It is still another object of this invention to provide a power supply that draws nearly a pure sine wave of current from a power line, which minimizes root mean square input current for a given output power.

It is still another object of this invention to provide a relatively economical power supply which achieves a unity power factor without adding costly components.

These and other objects of this invention are achieved, according to one preferred embodiment, with an induction heating power supply delivering a high-frequency constant output current to an inductive heating apparatus. The induction heating power supply accepts a variable input voltage and converts the variable input voltage to a regulated output voltage through a pre-regulator. The resultant regulated output voltage is inverted with an H-bridge inverter thus generating a high-frequency constant output voltage. The high-frequency constant output voltage is then amplified and converted to the high-frequency constant output current using a tuned output network.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
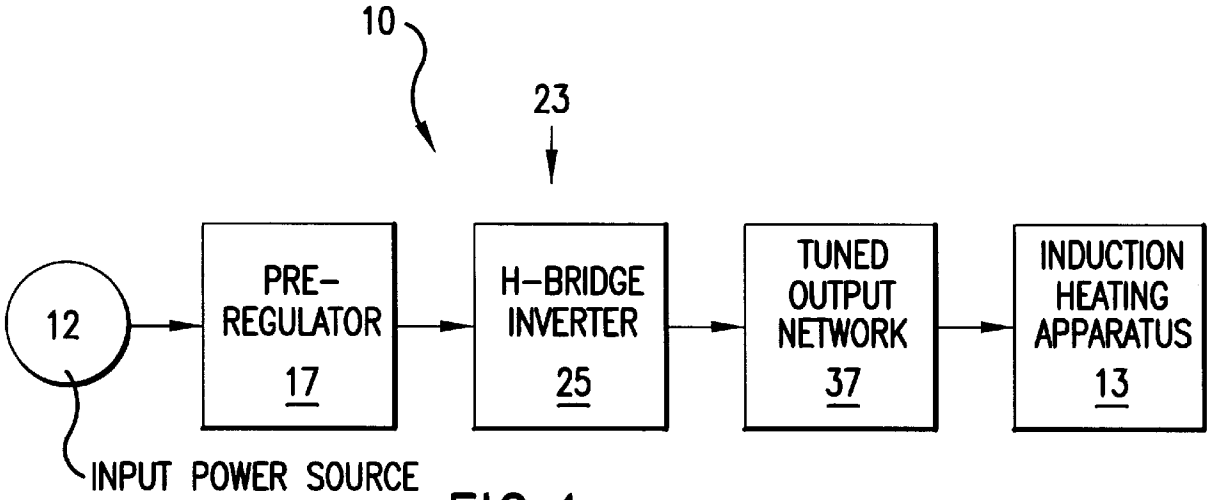
FIG. 1 shows a schematic block diagram of an induction heating power supply, according to one preferred embodiment of this invention.

A schematic view of an induction heating power supply 10 is shown in FIG. 1. The induction heating power supply 10 accepts a variable input voltage from an input power source 12. The induction heating power supply 10 can be powered from a variety of input power sources 12 including conventional power lines, generators, batteries and/or inverters. The wide potential of input power sources 12 require that the induction heating power supply 10 be compatible with a wide range of input voltages, such as those ranging from about 90 VAC to about 190 VAC. Because of the possible variation of input power sources 12 the induction heating power supply 10 preferably accepts a range of input voltage waveforms, including any one or combination of square, sinusoidal, triangular and dc waveforms.

The variable input voltage delivered by the input power source 12 is preferably converted to a regulated output voltage through a two stage output section. Regulated output voltage as described throughout this specification and the claims refers to an output voltage that follows a repeating frequency envelope. In one preferred embodiment of this invention, current at the variable input voltage first passes through a pre-regulator 17. The pre-regulator 17 is connected between the input power source 12 and an inversion means 23. The pre-regulator 17 regulates the variable input voltage, providing a regulated input voltage to the inversion means 23. A buck converter, a switch-mode converter or another suitable converter known to those skilled in the art can be used as the pre-regulator 17. The pre-regulator 17 regulates the peak voltage as well as the root mean square voltage delivered to the inversion means 23. Additionally, the pre-regulator 17 operation results in a clean sine wave of current drawn from the input power source 12. The pre-regulator 17, contrary to the inversion means 23, is free to operate at a lower frequency, such as about 50 kHz, allowing the pre-regulator 17 to handle the regulation function much more efficiently than the inversion means 23.

The inversion means 23 inverts the resultant regulated output voltage from the pre-regulator 17 and thus generates a high-frequency constant output voltage. In one preferred embodiment, the inversion means 23, which generates the high frequency ac output signal, comprises an H-bridge inverter 25. The H-bridge inverter 25 preferably comprises a plurality of metal-oxide-semiconductor field-effect transistors 26. Each field-effect transistor 26 is a voltage-controlled device in which the current conduction between the source and the drain regions is controlled by a control voltage applied to a gate terminal. The field-effect transistors 26 such as those used in an embodiment of this invention preferably offer very short switching times and minimum energy requirements for triggering. The H-bridge inverter 25 is preferably designed to account for the recovery interval of energy stored in an induction coil after each conduction period of the respective field-effect transistor 26 of the H-bridge inverter 25, so that the energy is recovered before the opposite field-effect transistor of the bridge starts conducting.

According to one preferred embodiment of this invention, the H-bridge inverter 25 receives a regulated input voltage from the pre-regulator 17. There are several advantages of having this regulated input voltage. Regulating the input voltage to a predetermined value of about 70 volts, from a potential range of about 90 volts to about 190 volts, greatly reduces the power losses and, therefore, the size and cost of the H-bridge inverter 25. By regulating the input voltage the H-bridge inverter 25 does not need to perform regulation, and the H-bridge inverter 25 can operate at resonance and thus greatly reduce the switching losses in the H-bridge inverter 25. Therefore, the size and cost of the H-bridge inverter 25 according to this invention are greatly reduced. Although theoretically proven, this particular advantage has not yet been fully realized because frequency sweeping has not yet been enabled. In order to find the resonant frequency of the load, the H-bridge inverter 25 has to sweep the frequencies in a predetermined range. When the power supply is started, the H-bridge inverter 25 frequency would be set to a frequency, minus a predetermined percentage (e.g. 400 kHz−10%). A control circuit can then begin to increase the switching frequency towards the set frequency. When the switching frequency reaches the set frequency, the frequency sweep stops and the switching frequency locks on the set resonant frequency. Once frequency sweeping is implemented, the size and cost of the H-bridge inverter 25 of this invention can be reduced by about 50%. The two above advantages can result in the added cost of the pre-regulator 17 components. However, in this embodiment of the induction heating power supply 10, the cost savings in the H-bridge inverter 15 25 are greater than the costs incurred in adding the pre-regulator 17. The reason that this technique is particularly more economical in this application is the fact that the H-bridge inverter 25 is required to operate at the output frequency, for example about 400 kHz, making it relatively inefficient. The pre-regulator 17, contrary to the H-bridge inverter 25, is free to operate at a lower frequency, such as about 50 kHz, allowing the pre-regulator 17 to handle the regulation function much more efficiently than the H-bridge inverter 25.

Figure 2:
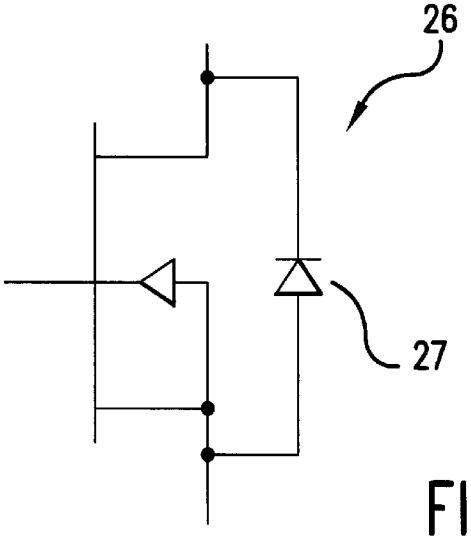
FIG. 2 shows a circuit diagram of an H-bridge inverter with an intrinsic diode, according to one preferred embodiment of this invention.
Figure 3:
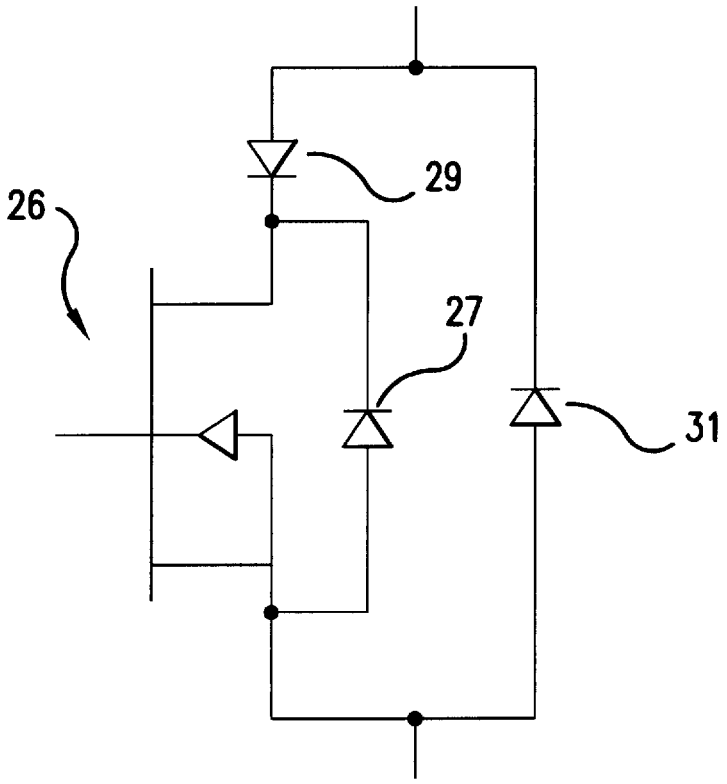
FIG. 3 shows a circuit diagram of the H-bridge inverter with current blocking and current conducting diodes, according to another preferred embodiment of this invention.

In one preferred embodiment, the H-bridge inverter 25 comprises reactive current diodes. Reactive current diodes are the diodes in the field-effect transistor 26 which handle part of the current waveform with reactive loads, such as those commonly encountered in induction heating applications. An intrinsic diode 27, shown in FIGS. 2 and 3, built into the field-effect transistor 26 is generally used for handling reactive loads. One problem possibly encountered in the induction heating power supply 10, is that the intrinsic diode 27 is not fast enough to handle a switching speed of about 400 kHz. Therefore, two discrete, high speed diodes are added to the field-effect transistors 26 of the H-bridge inverter 25 in one preferred embodiment of this invention, as shown in FIG. 3. A current blocking diode 29 is added to the field-effect transistors 26 of the H-bridge inverter 25 to block reactive current from flowing through the intrinsic diode 27 of the field-effect transistors 26 within the H-bridge inverter 25. A current conducting diode 31 is also added to the field-effect transistors 26 in the H-bridge inverter 25 to provide an alternate conduction path for the reactive current. The current conducting diode 31 operates at a much higher speed than the intrinsic diode 27 of the field-effect transistors 26 in the H-bridge inverter 25 which enables the system to operate at a much higher frequency. This is important for the induction heating power supply 10 because the H-bridge inverter 25 must operate at a very high frequency, such as about 400 kHz.

The induction heating power supply 10 of this invention can permit even pure capacitive reactive loads, at full current, to safely be driven by the H-bridge inverter 25. The resulting induction heating power supply 10 is very robust and very fault tolerant, and is able to drive a wide variety of difficult loads.

The high-frequency constant output voltage is preferably amplified and converted to a high-frequency constant output current using a tuned output network 37. An output voltage transformation device preferably amplifies the H-bridge inverter 25 output voltage to at least the voltage necessary to drive the various induction heating tools. A relatively common output voltage transformation device known from the prior art is a voltage transformer. In one embodiment of this invention, however, a tuned output network 37 is used in place of a conventional voltage transformer. This tuned output network 37 performs the necessary voltage amplification function and also has two other benefits over the conventional voltage transformer. First, the tuned output network 37 performs load regulation because the tuned output network 37 is a constant voltage to constant current converter. Since the required output of the induction heating power supply 10 is constant current, the tuned output network 37 releases the pre-regulator 17 and H-bridge inverter 25 sections from the requirement of performing load regulation and therefore the pre-regulator 17 and the H-bridge inverter 25 of this invention operate at their respective ideal voltages. This results in a smaller, less expensive pre-regulator 17 and H-bridge inverter 25 which is particularly useful for this application since the various load resistances vary over a range of about 20:1. The second advantage of the tuned output network 37 is the reduction of electromagnetic interference. The tuned output network 37 filters harmonics, thereby converting the square wave output voltage signal of the H-bridge inverter 25 to a sine wave which is ultimately sent to the induction heating apparatus 13. A sine wave output voltage signal will significantly reduce radiated electromagnetic interference, especially at more important higher frequencies such as radio frequencies.

Figure 4:
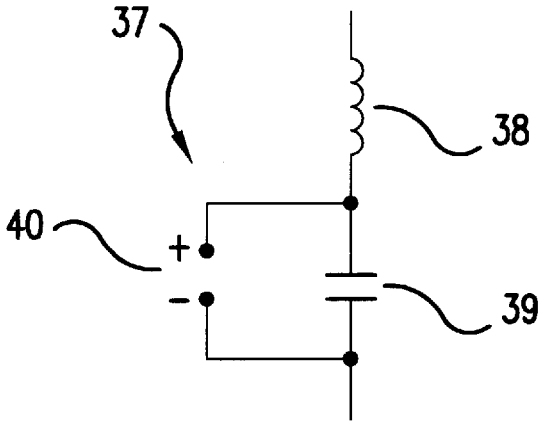
FIG. 4 shows a circuit diagram of a tuned output network, according to yet another preferred embodiment of this invention.

In one preferred embodiment of this invention, as shown in FIG. 4, the tuned output network 37 comprises an inductor 38 and a capacitor 39, preferably connected in series. The capacitor 39 is connected in parallel with a load 40 created by an induction heating apparatus 13 of the induction heating power supply 10.

Large filter capacitors are often present on the output of a conventional rectifier, or in the pre-regulator 17 of the present invention. However, in one preferred embodiment of this invention, the induction heating power supply 10 does not contain large filter capacitors. This fact, combined with the manner in which the pre-regulator 17 performs line regulation, results in a current waveform drawn from the input power source which is the same as for a resistor load. This results in unity power factor (power factor=1) which is optimum for transferring the maximum amount of power from the input power source 12 for a given root mean square current. This benefit was realized according to this invention by deleting the large, expensive, filter capacitors rather than by adding a power factor correction stage, as is done in some conventional power supplies. A result of deleting the input filter capacitors is that the final high-frequency output is modulated by the line input waveform. In some applications this may be a problem, but for the application of one preferred embodiment of this invention, pipe fusing, the modulated output waveform is acceptable. As a result of eliminating the filter capacitors, which reduces the size and cost of the power supply, and by designing the pre-regulator 17 as described, the benefit of unity power factor is achieved.

The induction heating power supply 10 ultimately delivers a high-frequency constant output current to the induction heating apparatus 13. The induction heating apparatus 13 of one preferred embodiment comprises a jacket for fusing a coupling device between ends of two plastic pipes. It is apparent that the induction heating apparatus 13 described throughout this specification and in the claims may comprise various cooking elements, heating coils for food and liquids, and any other suitable apparatus used for various heating and melting applications, particularly those which require induction heating.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A method for delivering a high-frequency constant output current to an inductive heating apparatus, the method comprising the steps of:

converting a variable input voltage to a regulated output voltage with a pre-regulator;

inverting the regulated output voltage to generate a high-frequency constant output voltage with an H-bridge inverter;

amplifying the constant output voltage with a tuned output network;

converting the amplified constant output voltage to the high-frequency constant output current; and delivering the high-frequency constant output current to the inductive heating apparatus.

2. The method according to claim 1 wherein the regulated output voltage is inverted by passing a reactive current through the H-bridge inverter.

3. The method according to claim 2 wherein the reactive current is blocked from flowing through an intrinsic diode of a field-effect transistor within the H-bridge inverter.

4. The method according to claim 2 wherein the reactive current is provided an alternate current path through an external conducting diode.

5. The method according to claim 2 wherein the regulated output voltage is inverted at resonance.

6. The method according to claim 1 wherein the high-frequency constant output current is modulated with a line input waveform.

7. The method according to claim 1 wherein the high-frequency constant output current follows a square wave.

8. The method according to claim 1 wherein the high-frequency constant output current follows a sinusoidal wave.

9. In combination, an induction heating apparatus and an induction heating power supply for receiving a variable input voltage and emitting a high-frequency constant output current to the induction heating apparatus, the induction heating power supply comprising:

a pre-regulator receiving the variable input voltage and converting the variable input voltage to a regulated output voltage;

an H-bridge inverter receiving the regulated output voltage and generating a high-frequency constant output voltage, the H-bridge inverter connected with respect to the pre-regulator; and a tuned output network amplifying the constant output voltage and converting the constant output voltage to the high-frequency constant output current, the tuned output network connected with respect to the H-bridge inverter and the induction heating apparatus.

10. The induction heating power supply according to claim 9 wherein the pre-regulator comprises a buck regulator.

11. The induction heating power supply according to claim 9 wherein the pre-regulator comprises a switch-mode converter.

12. The induction heating power supply according to claim 9 wherein the high-frequency constant output current follows a square wave.

13. The induction heating power supply according to claim 9 wherein the high-frequency constant output current follows a sinusoidal wave.

14. The induction heating power supply according to claim 9 wherein the H-bridge inverter comprises at least one field-effect transistor containing an intrinsic diode, a current blocking diode blocking a reactive current from the intrinsic diode and a conducting diode passing the reactive current through the field-effect transistor of the H-bridge inverter.

15. The induction heating power supply according to claim 9 wherein the tuned output network comprises an inductor and capacitor in series and a load in parallel with the capacitor.

16. The induction heating power supply according to claim 9 wherein the high-frequency constant output current is an alternating current.

* * * * *